United States Patent [19]

Schnoor et al.

[11] Patent Number: 4,667,667

[45] Date of Patent: May 26, 1987

[54] PROTECTIVE HELMET HAVING NOSE PASSAGE CLOSURE ELEMENTS

[75] Inventors: Christian Schnoor; Wolfgang Diehl, both of Lubeck, Fed. Rep. of Germany

[73] Assignee: Drägerwerk AG, Fed. Rep. of Germany

[21] Appl. No.: 785,888

[22] Filed: Oct. 9, 1985

[30] Foreign Application Priority Data

Oct. 11, 1984 [DE] Fed. Rep. of Germany ..... 3437310

[51] Int. Cl.[4] ..... A62B 7/00

[52] U.S. Cl. ..... 128/201.18; 128/201.24; 128/206.26

[58] Field of Search ..... 128/201.23, 201.25, 128/201.26, 201.27, 203.22, 203.18, 206.11, 206.12, 206.21, 206.24, 206.26, 206.28, 206.29, 207.18, 342, 344, 346

[56] References Cited

U.S. PATENT DOCUMENTS

| | | | |
|---|---|---|---|
| Re. 31,424 | 10/1983 | Ernsting et al. | 128/201.18 |
| 1,105,127 | 7/1914 | Drager | 128/206.26 |
| 1,873,160 | 8/1932 | Sturtevant | 128/206.11 |
| 1,978,994 | 10/1934 | Fortunato | 128/201.18 |
| 2,265,387 | 12/1941 | McMillin | 128/342 |
| 4,102,342 | 7/1978 | Akiyama et al. | 128/342 |
| 4,470,413 | 9/1984 | Warncke | 128/206.29 |
| 4,559,940 | 12/1985 | McGinnis | 128/206.26 |

FOREIGN PATENT DOCUMENTS

| | | | |
|---|---|---|---|
| 156627 | 12/1904 | Fed. Rep. of Germany | 128/206.29 |

*Primary Examiner*—Henry J. Recla

*Attorney, Agent, or Firm*—McGlew and Tuttle

[57] ABSTRACT

A protective cap comprises closure elements, by the operation of which the narices can be closed for the purpose of pressure equalization in the middle ear in overcoming extreme differences in altitude. To be able to execute the operation without visual impairment, it is provided that the closure elements are designed as motion elements variable in their extent, which are connected to a flow medium contained in feed lines which is pressurized by an operating element displacing the flow medium.

4 Claims, 2 Drawing Figures

PROTECTIVE HELMET HAVING NOSE PASSAGE CLOSURE ELEMENTS

FIELD AND BACKGROUND OF THE INVENTION

This invention relates in general to the construction of safety helmets and in particular to a new and useful device adapted to be associated with the safety helmet for the closing of the narices.

The invention relates to a protective cap with closure elements serving to close the narices, which closure elements are arranged on a support present inside the protective cap and are connected with devices for the transmission of force of an operating element received from the outside of the protective cap.

A similar protective cap is known from German OS No. 28 53 213.

Protective caps of this kind are used in respirators, in diving, for the flight personnel in aviation, and generally wherever the facial or head area must be protected from access of nonbreathable gases or where respiration is to be made possible by suitable aids.

In the known protective cap, there is a support in the form of a half-mask, at which a lever is pivotably passed through each side of the nose region of the cap and which includes a roll drum fastened to the end of each lever. On the outside the levers are joined by an operating strap. In an inoperative position the strap rests, flapped down, against the cap, the drums standing erect in the interior. As the straps are flapped up, the drums roll down on the inner mask on both sides of the nose portion and compress the narices by way of the mask.

Such a device for closing the narices is meaningful when the wearer of the protective cap must overcome great differences in altitude within short periods. This is the case when, for example, divers must go down to great depths. It is very useful to pilots who fly at high altitudes and are supplied with oxygen through a mask. At an extreme rate of drop, the pilot must provide for pressure equalization between his surrounding and the inner auditory canal. Some of the pilots can achieve this pressure compensation by swallowing or by movement of the lower jaw. Others can bring such a pressure equalization about only by a pressure variation in the nose-throat region with the nose closed. Such a manipulation is called in technical language "Valsalva's maneuver". Preferably it should be possible to be carried out by the pilot without alteration at the protective cap from the outside. In the known device it is found to be disadvantageous that the pilot must, to carry out this manipulation, move his arm into the field of vision of the protective cap, whereby his field of sight is greatly restricted at least for a short period, but which cannot be neglected at the high flight velocities. In addition, the strap must be left in flapped-up position until the pressure equalization is carried out. During this time the strap hinders the pilot in the free view through the viewing pane onto his flight instruments.

Another device for the execution of the "Valsalva maneuver" is known from GB-A-20 47 545. In it are shown two pressure pieces attached under spring load in the mask, which are connected by a flexible band passing under the nose. During the upward displacement of the mask, the band applies against the nose and pulls the pressure pieces together laterally. The required pivoting of the cap and mask is complicated, impairs the tight seal, and interferes with the vision at crucial moments. Moreover, the parts projecting into the mask space are a hinderance in wearing the mask.

SUMMARY OF THE INVENTION

The invention provides an improved protective cap with a device for closing the narices which can be operated by the user from the outside, without impairment of the field of vision, in such a way that manipulations in the vicinity of the cap space are not necessary.

In accordance with the invention the closure elements are connected through a flow medium contained in feed lines to an operating element which displaces the flow medium.

The advantage of the invention is that the device for closing the narices can be operated without having to pass through manipulators in the sight region of the protective cap; instead, the user can himself determine the pressure necessary for closing the narices by actuating the operating element designed for example as a pump.

In particular, the device for closing the narices can be adapted without difficulties to any face profile of a mask wearer by the advantageous use of expandable plastic cushions.

To facilitate the handling further, it may advantageously be provided that the support comprises positioning means for the motion elements, when they apply in advantageous manner in the regions of a half-mask that cover the narices. Thus the pressure onto the narices is distributed in advantageous manner over a larger area, pressure points in the narice region being avoided. The support forms the abutment.

In a further development of the invention, the adjusting means for the motion element may be slot type cutouts in the side portions of the support; alternatively a seating device for the motion elements, adapted for multi-axis displacement, may be provided on the support.

Accordingly it is an object of the invention to provide an improved device for closing the narices of a person wearing a protective helmet which includes means for circulating a fluit to expandable pressure cushions which serve to close the narices.

A further object of the invention is to provide a device for association with a protective helmet which includes means for rapidly closing the narices of a person in order to facilitate the equalization of the transmission of pressure forces to the person.

A further object of the invention is to provide a device for use by a person subject to pressure changes which includes means for closing the narices for a predetermined period which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
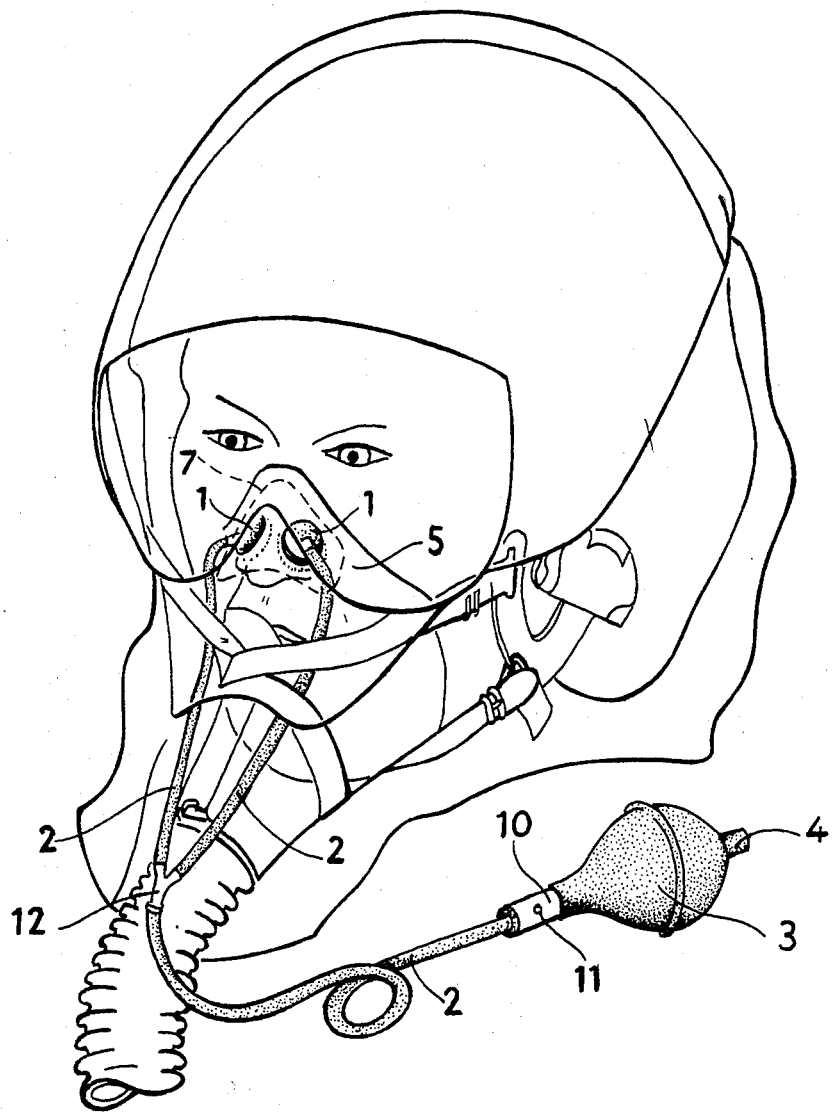
FIG. 1 is a protective front view of a cap with the devices necessary for closing the narices constructed in accordance with the invention.
Figure 2:
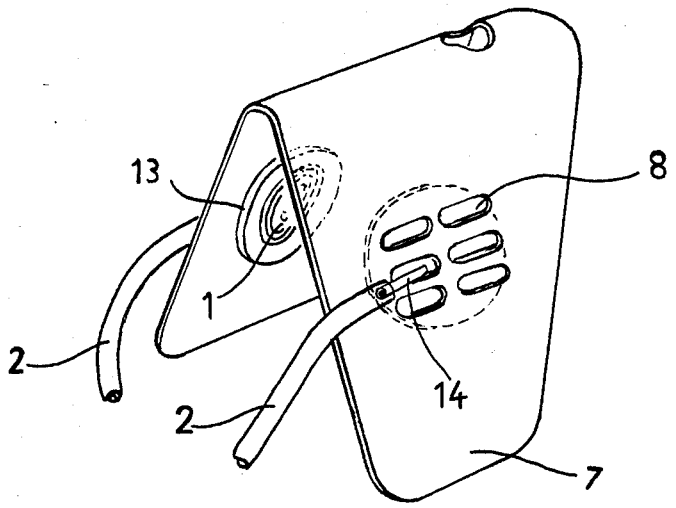
FIG. 2, the support.

Referring to the drawings in particular the invention embodied therein comprises a device for at least partially closing the nasal passages of a wearer which includes means for rapidly circulating a fluid to expandable plastic cushions which engage over the person's nose and which includes means for either automatically or manually operating the device to effect the closure.

A bulb-shaped operating element 3 is connected with a supply line 2 via a connecting piece 10 with a vent hole 11. At a Y-shaped connecting piece 12 the supply line 2 divides into two branches, which are connected with extensible plastic cushions 1, in the nose region of a half-mask 5.

The plastic cushions 1 are fastened on a circular disc 13 and lie with the disc on the inside of a V-shaped support 7 which surrounds the nose region over the half-mask 5. The feed lines 2 go from the outside to the connecting tubes 14, which lead into a cavity of the plastic cushions 1. The curved connecting tubes 14 engage through the support at the sidewalls thereof through one of the adjusting means 8 in the form of slot type cutouts. The position of support 7 is shown in phantom line in FIG. 1 to reveal the positions for the cushions 1.

The mode of operation of the closure elements makes it easy and convenient for the user to handle the device. The user squeezes the bulb type operating element 3, whereby pressure is created in the feed lines 3 and cushions 1, which inflates the cushions 1 and presses against the narices. The user can now let go of the bulb 3, and the pressure in the interior of the feed lines 2 and plastic cushions 1 gradually reduces in accordance with the cross-section of the venting hole 11. During this time it becomes possible for the user to bring about the pressure equalization within his eustachian tube. While the pressure escapes from the venting hole 11, the interior of the bulb-shaped operating element 3 is closed against back flow by a check valve therein (not shown) acting against the feed line 2. Upon release of the compressed operating element 3, its volume fills up again via an opening check valve in the inlet 4 from the surrounding atmosphere. In this manner the user is able, should his efforts of pressure equalization have failed, to actuate the device again at short intervals of time.

While specific embodiments of the invention have been shown and described in detail to illustrate the application of the principles of the invention, it will be understood that the invention may be embodied otherwise without departing from such principles.

What is claimed is:

1. A device for use with a half-mask adapted to fit around the nose and mouth of a wearer, comprising a support member adapted to overlie each side of the nasal region of said half-mask, a pair of expandable plastic cushions connected to said support member and positioned to overlie each side of the nasal region of said half-mask and thereby each respective side of the person's nose, whereby each expandable plastic cushion expands against a respective side of said half-mask and thereby against the person's nose when a fluid medium is supplied to said plastic cushion, a tube for carrying a fluid medium connected to each plastic cushion and extending away from said support member, a squeezable bulb connected to said tube at a location spaced from said support member, said bulb being squeezable to cause a flow of fluid medium from said bulb through said tube and into said plastic cushions to expand said plastic cushions against said half-mask and thereby the person's nose to close the person's nasal flow passages, said tube including a supply portion connected to said bulb, a Y-connecting piece connected to said supply portion and a pair of cushion portions each connected between said Y-connecting piece and one of said plastic cushions.

2. A device according to claim 1, including a check valve in said bulb for preventing a backflow of fluid medium from said tube to said bulb, said bulb having a closeable inlet for passing fluid medium into said bulb when said bulb is released after it has been squeezed.

3. A device according to claim 2, including a connecting piece connected between said bulb and said tube, downstream of said check valve in said bulb, said connecting piece having a vent hole therein for venting fluid medium from said tube and from said expandable plastic cushions to permit said cushions to contract away from the person's nose to open the nasal flow passages of the person's nose

4. A device according to claim 1, including a connecting piece between said bulb and said supply portion, said connecting piece having a vent hole therein for venting fluid medium from said tube and from said plastic cushions to permit said plastic cushions to contract after they have expanded.

* * * * *